US008647176B2

(12) United States Patent
Schmitz

(10) Patent No.: US 8,647,176 B2
(45) Date of Patent: Feb. 11, 2014

(54) METHOD AND APPARATUS FOR GRINDING A WORKPIECE SURFACE OF ROTATION

(75) Inventor: Roland Schmitz, Vaihingen (DE)

(73) Assignee: Emag Holding GmbH, Salach (DE)

( * ) Notice: Subject to any disclaimer, the term of this patent is extended or adjusted under 35 U.S.C. 154(b) by 192 days.

(21) Appl. No.: 13/154,471

(22) Filed: Jun. 7, 2011

(65) Prior Publication Data

US 2012/0003904 A1 Jan. 5, 2012

(30) Foreign Application Priority Data

Jul. 3, 2010 (DE) ..... 10 2010 026 026

(51) Int. Cl.
*B24B 5/01* (2006.01)

(52) U.S. Cl.
USPC ..... 451/63; 451/49

(58) Field of Classification Search
USPC ..... 451/57, 58, 49, 246, 249
See application file for complete search history.

(56) References Cited

U.S. PATENT DOCUMENTS 7,118,453 B2 * 10/2006 Hori et al. ..... 451/11
7,530,882 B2 * 5/2009 Soma et al. ..... 451/11
2008/0311828 A1 * 12/2008 Itoh et al. ..... 451/49

* cited by examiner

*Primary Examiner* — Robert Rose
(74) *Attorney, Agent, or Firm* — Andrew Wilford

(57) ABSTRACT

A workpiece having a planar face the workpiece is rotated about a workpiece axis substantially perpendicular to the planar workpiece face, and a grinding disk centered on a disk axis is rotated about the disk axis. The disk has an annular planar disk face perpendicular to and centered on the disk axis and an annular frustoconical disk face extending from an edge of the planar disk face, centered on the disk axis, and angled inward from the planar disk face. A portion of the annular face is oriented perpendicular to the workpiece axis and pressed against the planar workpiece face to premachine most of the planar workpiece face. Thereafter the disk is pivoted and oriented parallel the planar workpiece face to finish machine the planar workpiece face with the planar disk face.

12 Claims, 4 Drawing Sheets

METHOD AND APPARATUS FOR GRINDING A WORKPIECE SURFACE OF ROTATION

FIELD OF THE INVENTION

The present invention relates to grinding a face of revolution. More particularly this invention concerns a method of an apparatus for finish-grinding such a face.

BACKGROUND OF THE INVENTION

In order to grind a planar face of revolution of a workpiece, it is standard to rotate the workpiece while engaging it against a rotating grinding disk. In straight plunge-cut grinding of end faces, only a relatively small area of the abrasive workpiece comes into contact with the workpiece. This results in irregular wear in the edge area of the grinding wheel, which must also be corrected by machining a relatively large amount of material off the grinding wheel when dressing it.

U.S. Pat. No. 7,530,882 discloses a method of machining side faces of crankshaft bearings in the contact face between the grinding wheel and the workpiece is enlarged by a zigzag-shaped plunge-cut movement and wear is optimized.

OBJECTS OF THE INVENTION

It is therefore an object of the present invention to provide an improved method and apparatus for grinding a surface of rotation.

Another object is the provision of such an improved method and apparatus for grinding a surface of rotation that overcomes the above-given disadvantages, in particular that allows short cycle time and reduces the stress on the grinding wheel.

Another object of the invention is to provide a grinding machine for implementing the method.

SUMMARY OF THE INVENTION

In a method of machining a workpiece having a planar face the workpiece is rotated about a workpiece axis substantially perpendicular to the planar workpiece face, and a grinding disk centered on a disk axis is rotated about the disk axis. The disk has an annular planar disk face lying in a plane perpendicular to the axis and centered on the disk axis and an annular frustoconical disk face extending from an edge of the planar disk face, centered on the disk axis, and angled inward relative to the disk axis from the planar disk face. A portion of the annular face is oriented perpendicular to the workpiece axis and simultaneously is pressed axially of the workpiece axis against the planar workpiece face and shifted it along the planar workpiece face perpendicular to the workpiece axis to premachine most of the planar workpiece face. Thereafter the disk is pivoted and oriented parallel the planar workpiece face to finish machine the planar workpiece face with the planar disk face.

Thus according to the invention, a grinding wheel having a frustoconical face and a planar face is used in the inventive method. The planar face is preground with the frustoconical face according to this method and the machining is finished with the planar face. Unlike the prior art, the entire face of the grinding part of the wheel engages the workpiece, so that the abrasive layer is subject to uniform wear. Since the outside edges of the grinding wheel are protected in a particularly advantageous manner here, less material is to be removed from the outer lateral face in dressing. This yields a substantial cost advantage in the case of high-quality CBN grinding wheels in particular.

BRIEF DESCRIPTION OF THE DRAWING

The above and other objects, features, and advantages will become more readily apparent from the following description, reference being made to the accompanying drawing in which.

DETAILED DESCRIPTION

Figure 1:
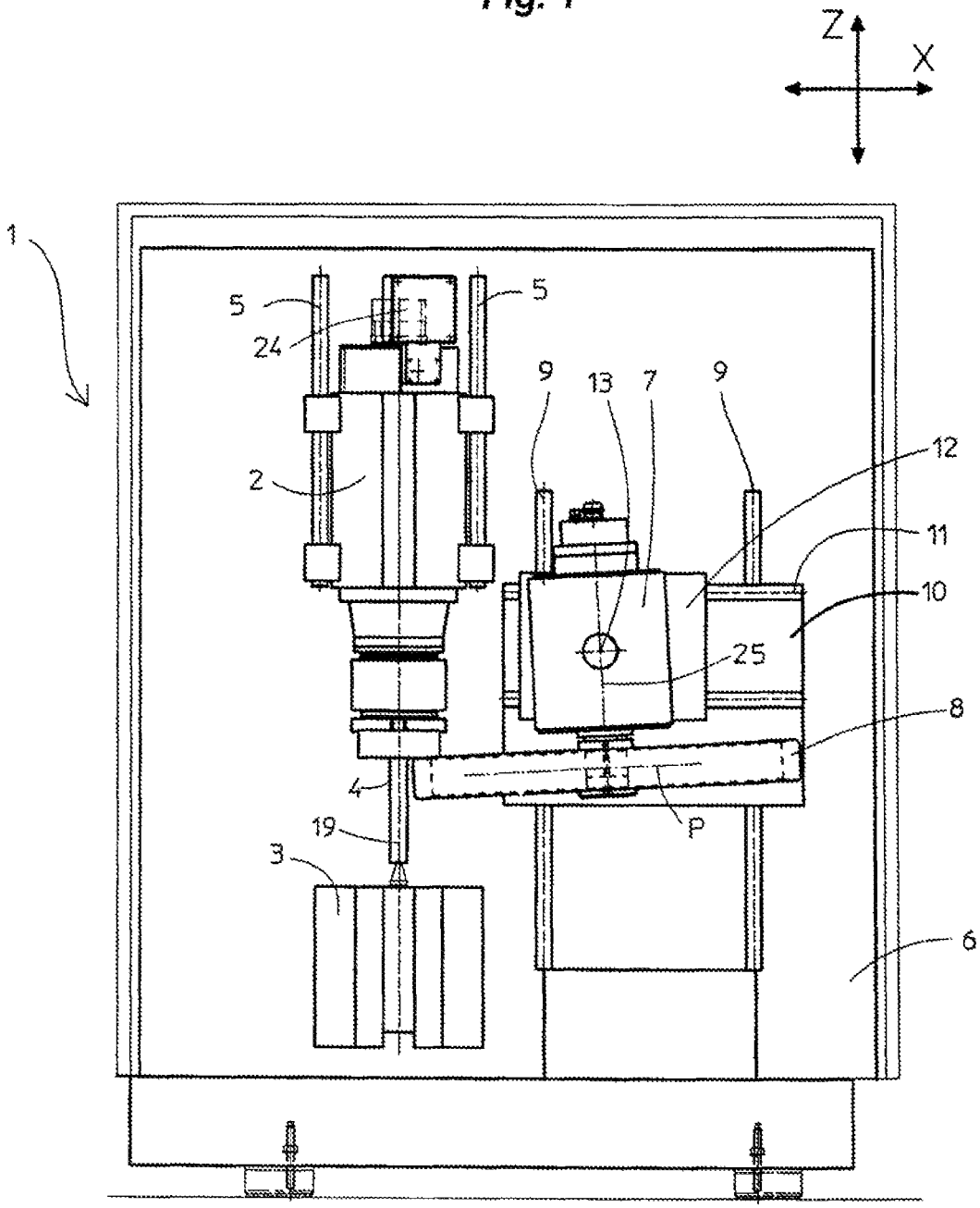
FIG. 1 is a side elevational and partly schematic view of a grinding machine according to the invention.

FIG. 1 shows a grinding machine 1 having a frame 6 on which are supported Z-axis vertical guides 5 and a tailstock 3 defining a vertical workpiece axis 19. A headstock/chuck 2 is vertically shiftable on the guides 5 so that a workpiece 4 can be held with its lower end chucked in the tailstock 3 for rotation by a drive 24 about the axis 19.

A grinding wheel or disk 8, which is described in more detail below, is centered on an axis 25 and carried on a drive 7 that in turn can pivot about a horizontal Y axis 13 on a horizontal support slide 12 carried on horizontal X-axis guides 11 in turn carried on a vertical support slide 10 shiftable along vertical Z-axis guides 9. Thus this wheel 8 can be displaced horizontally along the X axis, vertically along the Z axis and can be pivoted about the horizontal Y axis 13 that is perpendicular to the axis 25 the wheel 8 is continuously rotated about by the drive 7.

Figure 2:
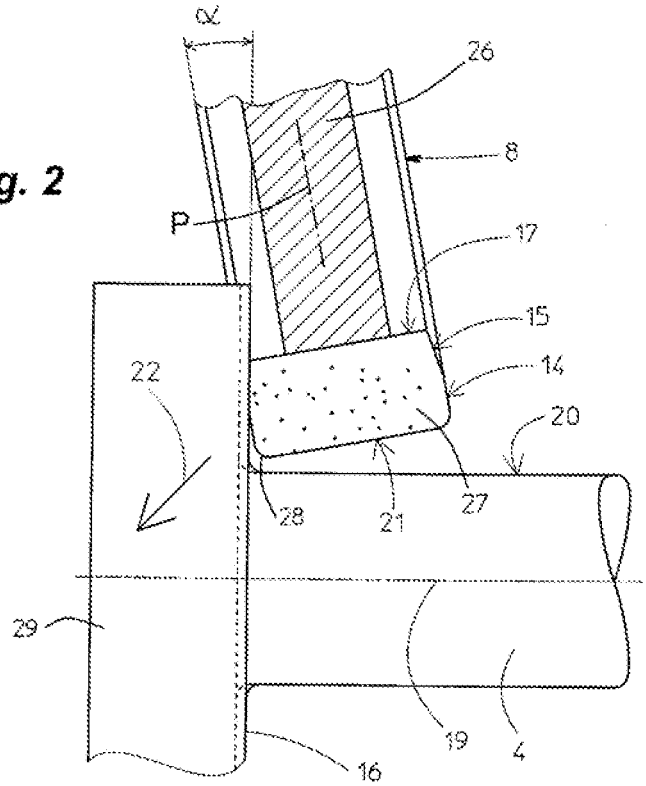
FIG. 2 is a large-scale view illustrating a first step of the grinding process according to the invention.
Figure 6:
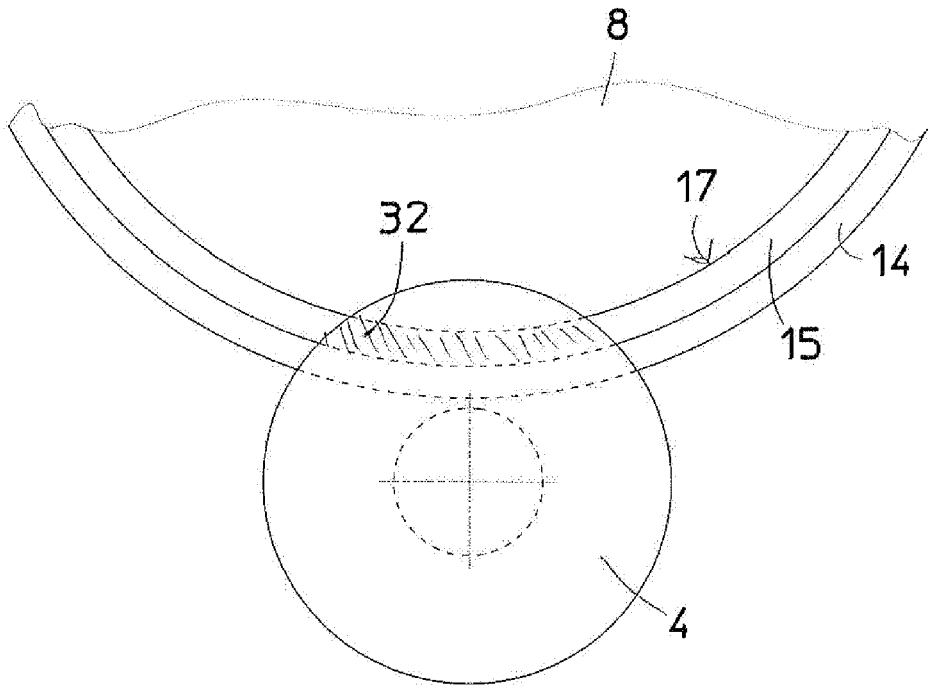
FIG. 6 is an end view illustrating the parts in the position of FIG. 2.

FIGS. 2 and 6 show the engagement of the grinding wheel 8 on the workpiece 4 with the grinding wheel 8 shown in cross section in FIG. 2. It has a planar outer annular face 14 extending from the outer periphery. Immediately inward from the planar face 14 is a frustoconical and inner annular face 15 centered like the face 14 on the axis 25 and flaring radially outward therefrom so that the respective side of the wheel 8 is dished. The two faces 14 and 15 meet at a circular edge 23 where they form a large obtuse angle of 175° or more to each other. The wheel 8 has a circular center disk 26 with opposite planar end faces parallel to each other and perpendicular to the axis 25 and the grinding part of the disk 8 is formed by an annular stone ring body 27 having a cylindrical inner face 17 bonded to the outer periphery of the disk 26. The dimension parallel to the axis 25 of this face 17 is substantially greater than the axial thickness between its end faces of the disk 26 so that this disk 26 is set considerably in from the actual grinding ring 27 of the disk 8. This ring 27 has a cylindrical outer face 21 centered on the axis 25 and meeting the planar outer ring face 14 at a rounded corner 28.

The workpiece 4, which can be a crankshaft, has a shaft 4 centered on the axis 19 and having a cylindrical outer face 20 and a large-diameter part, for instance a cheek 29, having an annular planar face 16 perpendicular to the axis 19 and forming with the face 20 a rounded corner 18.

Figure 3:
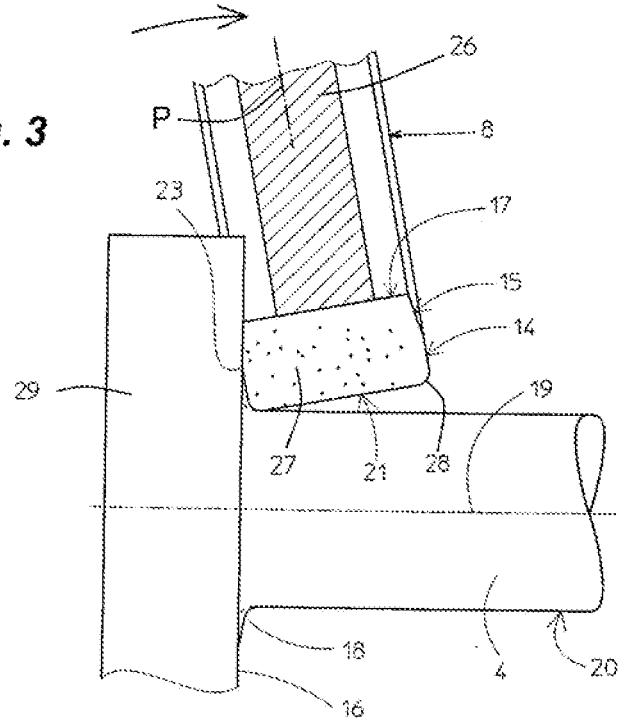
FIG. 3 is a view like FIG. 2 at the end of the first step.

In the first step of a grinding operation, the axis 25 of rotation of the grinding disk 8 is inclined by pivoting it about the pivot axis 13, so that the frustoconical face 15 is in flat face contact in a region 32 (FIG. 6) with the planar face 16 of the workpiece 4. The advancing movement is preferably performed in the direction of the arrow 22, that is at about a 45° angle to the axis 19. The planar face 16 is thus almost completely preground using only by the frustoconical face 15. Only in the corner 18 on the cylindrical part 20 does material that is yet to be removed remain between the planar face 16 and the planar face 14 of the grinding wheel 8 (FIG. 3).

The angle $\alpha$ between the frustoconical face 15 and the planar face 14 is an acute angle and is in a range between 0 and 5°. Based on the acute angle of inclination and due to the ratio of the grinding wheel diameter to the workpiece diameter, which is designed to be generous (greater than 4), the undercuts caused by the hollow frustoconical grinding face are negligible because they vary in an order of magnitude far below the grinding accuracy.

Figure 4:
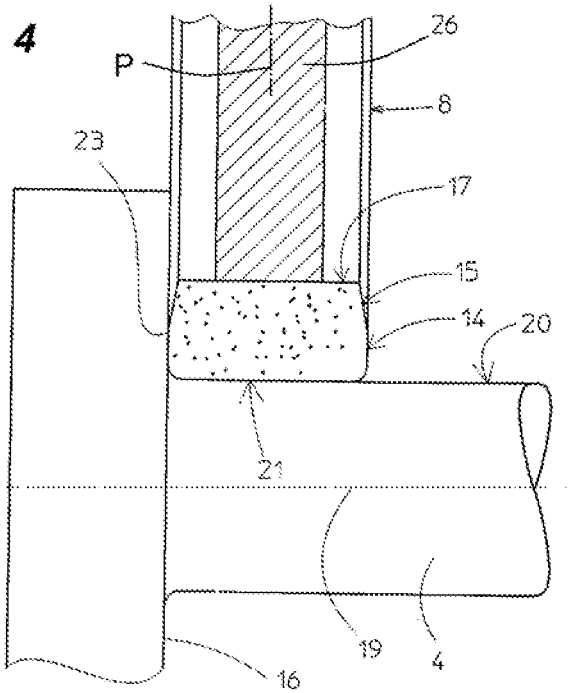
FIG. 4 shows the second grinding step according to the invention.

FIG. 4 shows the workpiece 4 in at the end of the grinding operation. For this, the planar face 14 has been aligned to be parallel with the planar face 16 by pivoting it about an imaginary axis through the edge 23. In so doing, the horizontal slide 12 and the vertical slide 10 are moved simultaneously in the direction of the X and Z axes while at the same time a pivoting movement is executed about the pivot axis 13. In this alignment operation, the outer face 21 of the grinding wheel is aligned parallel to the axis 19 and sits flatly on the cylindrical face 20 of the workpiece 4, so that this face 20 can also be machined. According to an advantageous embodiment of this method, the grinding wheel 8 is aligned with at least partially offset movements. After the pregrinding, the grinding wheel moves first in the direction of the X axis and is then pivoted about the pivot axis 13 and moved in the direction of the Z axis. Due to the combination of pregrinding with the frustoconical face 15 and finish grinding with the planar face 14 and/or with the outer face 21, the entire face of the abrasive layer in abrasive contact with the workpiece. This achieves particularly uniform wear.

Figure 5:
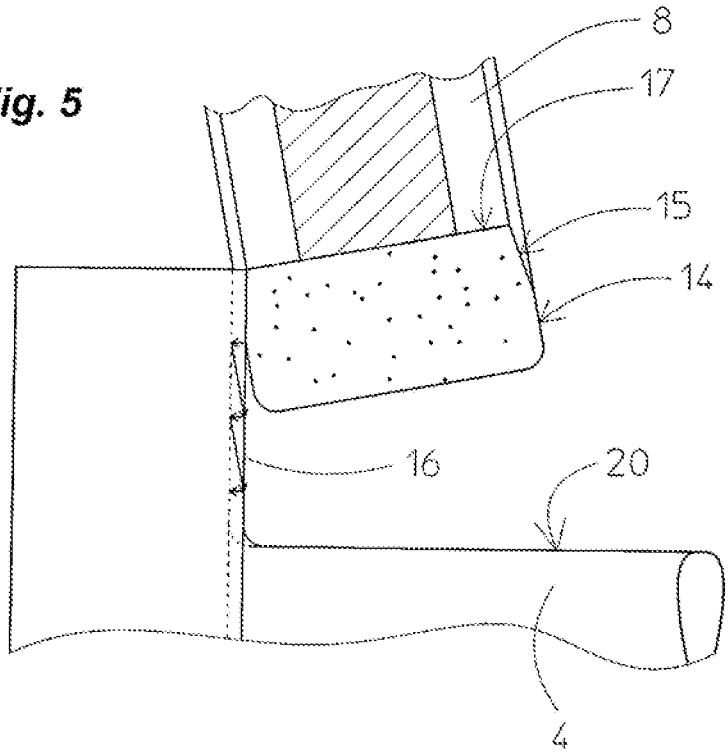
FIG. 5 indicates grinding with a zigzag advance of the tool.

FIG. 5 shows a variant for pregrinding where the planar face 16 is machined with a zigzag-shaped feed motion directed from the outside toward the center of the workpiece. This method is advantageous, for example, when a thicker layer of material must be ground off.

I claim:

1. A method of machining a workpiece having a planar face, the method comprising the steps of:

a) rotating the workpiece about a workpiece axis substantially perpendicular to the planar workpiece face;

b) rotating a grinding disk centered on a disk axis about the disk axis, the disk having an annular planar disk face centered on the disk axis and lying in a plane perpendicular to the disk axis and an annular frustoconical disk face extending from an edge of the planar disk face, centered on the disk axis, and angled inward from the planar disk face;

c) orienting a portion of the frustoconical annular disk face perpendicular to the workpiece axis and simultaneously pressing the portion against the planar workpiece face to premachine most of the planar workpiece face; and d) thereafter pivoting the disk and thereby orienting the planar disk face parallel to the planar workpiece face and finish machining the planar workpiece face with the planar disk face.

2. The machining method defined in claim 1, further comprising during the pivoting of step d) of:

shifting the disk both radially and axially of the workpiece axis.

3. The machining method defined in claim 1, further comprising the step during the pivoting of step d) of:

shifting the disk first only radially and then only axially of the workpiece axis.

4. The machining method defined in claim 1, further comprising during step c) the step of:

shifting the disk simultaneously axially and radially of the workpiece axis.

5. The machining method defined in claim 1, wherein the workpiece also has adjacent the planar workpiece face a cylindrical workpiece face centered on the workpiece axis and the disk has a cylindrical outer disk face centered on the disk axis, the method further comprising the step after step d) of:

e) pressing the cylindrical disk face against the cylindrical workpiece face.

6. The machining method defined in claim 1, further comprising during step c) the step of:

moving the workpiece in a stepped or zig-zag movement radially and axially of the workpiece axis.

7. An apparatus for machining a workpiece having a planar face, the apparatus comprising:

a grinding disk having an annular planar disk face lying in a plane perpendicular to the axis and centered on the disk axis and an annular frustoconical disk face extending from an edge of the planar disk face, centered on the disk axis, and angled inward from the planar disk face;

means for rotating the disk about the disk axis;

means for rotating the workpiece about a workpiece axis substantially perpendicular to the planar workpiece face;

means for orienting a portion of the annular face perpendicular to the workpiece axis and simultaneously pressing the portion against the planar workpiece face to premachine most of the planar workpiece face; and means for thereafter pivoting the disk and thereby orienting a portion of the planar disk face parallel the planar workpiece face and finish machining the planar workpiece face with the planar disk face.

8. The machining apparatus defined in claim 7 wherein the planar disk face is radially outwardly relative to the disk axis from the frustoconical disk face.

9. The machining apparatus defined in claim 7 wherein the planar disk face and the frustoconical disk face meet at a circular edge and there form an angle of 175° or more and less than 180°.

10. The machining apparatus defined in claim 7 wherein the disk has a center part set axially inward relative to the disk axis from the frustoconical face.

11. The machining method defined in claim 1, wherein steps a) and b) are carried out continuously while steps c) and d) are carried out.

12. The machining method defined in claim 11, wherein steps d) is performed after step c).

* * * * *